US010267120B1

(12) United States Patent
Roane et al.

(10) Patent No.: US 10,267,120 B1
(45) Date of Patent: Apr. 23, 2019

(54) FORMATION INTERFACE ASSEMBLY (FIA)

(71) Applicant: Halliburton Energy Services, Inc., Houston, TX (US)

(72) Inventors: Thomas Owen Roane, Alvord, TX (US); Antonio Rosas, Mesquite, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/846,529

(22) Filed: Dec. 19, 2017

(51) Int. Cl.

| | |
|---|---|
| ***E21B 33/12*** | (2006.01) |
| ***E21B 34/00*** | (2006.01) |
| ***E21B 34/10*** | (2006.01) |
| ***E21B 43/08*** | (2006.01) |
| ***E21B 43/14*** | (2006.01) |
| ***E21B 43/26*** | (2006.01) |

(52) U.S. Cl.
CPC ..... *E21B 34/103* (2013.01); *E21B 43/08* (2013.01); *E21B 43/26* (2013.01); *E21B 33/12* (2013.01); *E21B 43/14* (2013.01); *E21B 2034/002* (2013.01); *E21B 2034/007* (2013.01)

(58) Field of Classification Search
CPC ..... E21B 34/103; E21B 43/08; E21B 43/26; E21B 2034/007; E21B 43/14; E21B 2034/002; E21B 33/12
See application file for complete search history.

(56) References Cited

U.S. PATENT DOCUMENTS

| | | | | |
|---|---|---|---|---|
| 8,813,850 | B2 | 8/2014 | Geoffroy | |
| 8,960,296 | B2 | 2/2015 | East, Jr. | |
| 2002/0096328 | A1* | 7/2002 | Echols | E21B 43/045 166/278 |
| 2008/0283252 | A1 | 11/2008 | Guignard et al. | |
| 2015/0136403 | A1 | 5/2015 | Cheng et al. | |
| 2016/0032685 | A1 | 2/2016 | Roane et al. | |
| 2016/0356129 | A1 | 12/2016 | Broussard et al. | |

* cited by examiner

*Primary Examiner* — James G Sayre
(74) *Attorney, Agent, or Firm* — Scott Richardson; Parker Justiss, P.C.

(57) ABSTRACT

Provided is an oil/gas service tool assembly. The oil/gas service tool assembly, in this example, may include a washpipe apparatus, the washpipe apparatus including an uphole washpipe portion, and a downhole washpipe portion having washpipe perforations therein, wherein the uphole washpipe portion and downhole washpipe portion are telescopingly coupled to one another. The oil/gas service tool assembly, in this example, includes a washpipe check valve coupled downhole of the downhole washpipe portion.

24 Claims, 7 Drawing Sheets

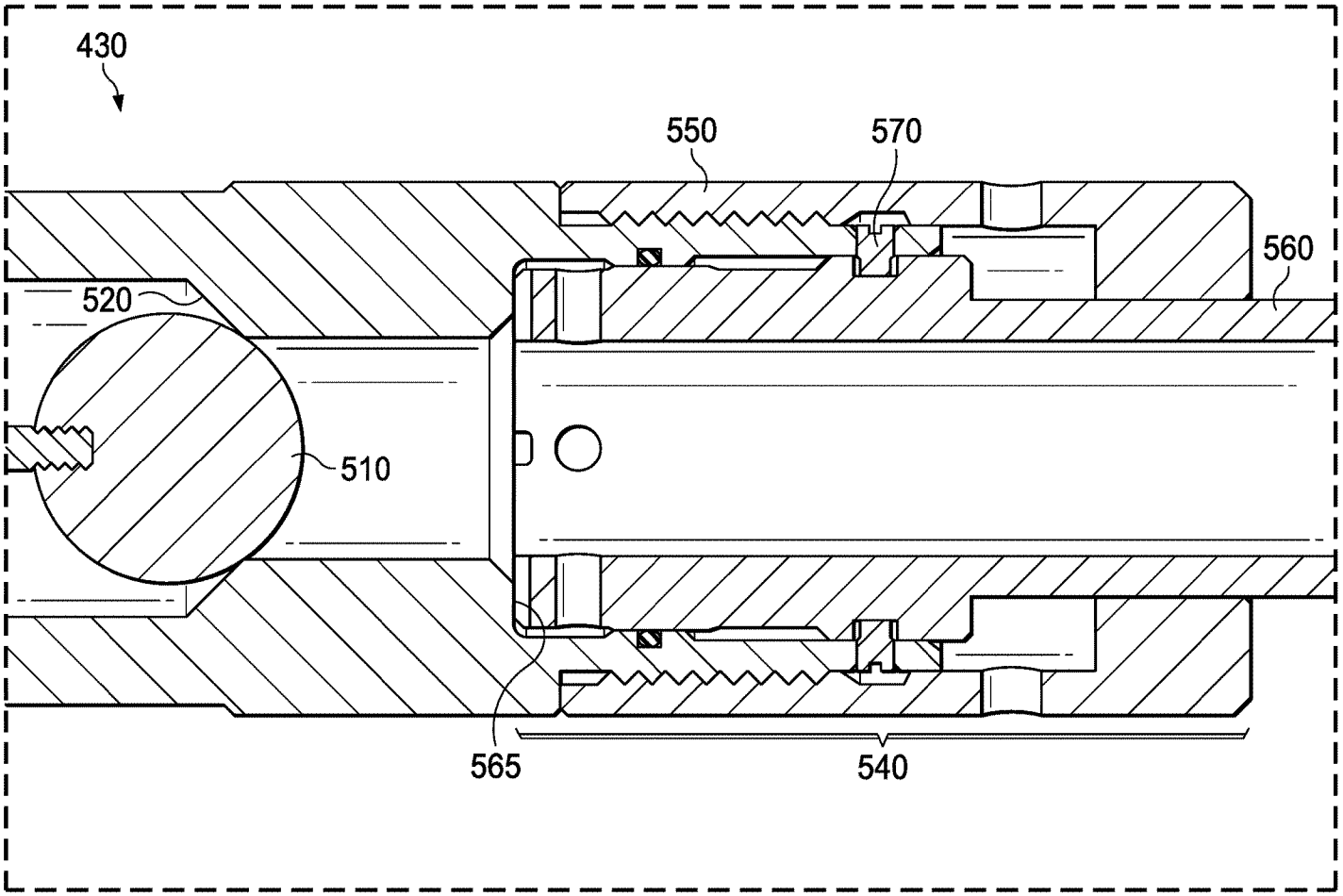
FIG. 5A/5B

FORMATION INTERFACE ASSEMBLY (FIA)

BACKGROUND

The process of fracking, also known as induced hydraulic fracturing, involves mixing sand and chemicals in water to form a frac fluid and injecting the frac fluid at a high pressure into a wellbore. Small fractures are formed, allowing fluids, such as gas, petroleum, and brine water, to migrate into the wellbore for harvesting. Once the pressure is removed to equilibrium, the sand or other particle holds the fractures open. Fracking is a type of well stimulation, whereby the fluid removal is enhanced, and well productivity is increased.

Multi stage hydraulic fracturing is an advancement to harvest fluids along a single wellbore or fracturing ring. The fracturing string, vertical or horizontal, passes through different geological zones. Some zones do not require harvesting because the natural resources are not located in those zones. These zones can be isolated so that there is no fracking action in these empty zones. Other zones have the natural resources, and the portions of the fracturing string in these zones are used to harvest from these productive zones.

In a multi-stage fracturing process, instead of alternating between drilling deeper and fracking, a system of frac sleeves (e.g. ball-drop) and packers are installed within a wellbore to form the fracturing string. The sleeves and packers are positioned within zones of the wellbore. Fracking can be performed in stages by selectively activating sleeves and packers, isolating particular zones. Each target zone can be fracked stage by stage without the interruption of drilling more between stages.

What are needed in the art are improved apparatus, systems, and methods for fracturing multi-stage zones.

BRIEF DESCRIPTION

Reference is now made to the following descriptions taken in conjunction with the accompanying drawings, in which.

DETAILED DESCRIPTION

Figure 1:
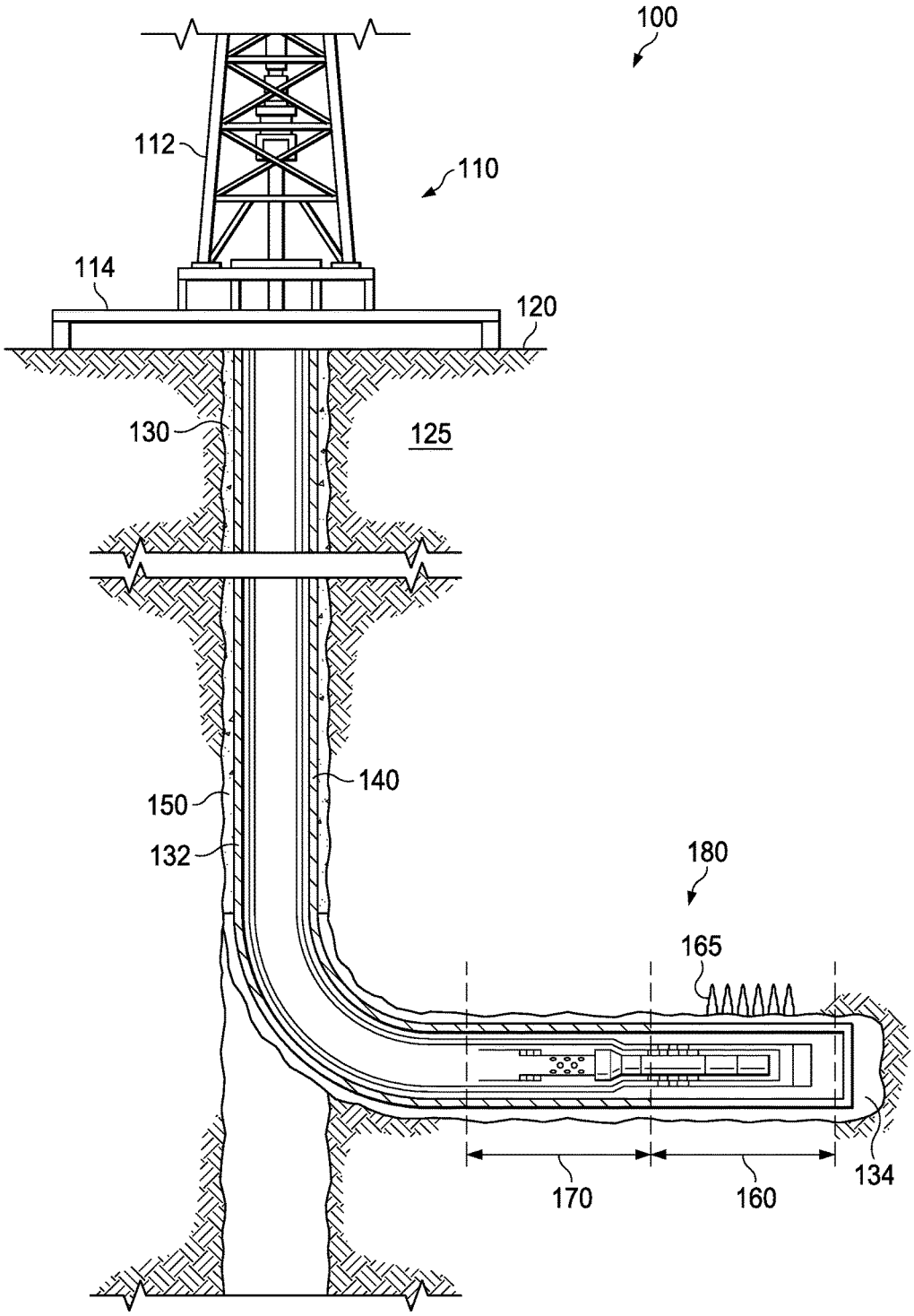
FIG. 1 illustrates a well system including an exemplary operating environment in accordance with the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Referring to FIG. 1, depicted is a well system 100 including an exemplary operating environment that the apparatuses, systems and methods disclosed herein may be employed. Unless otherwise stated, the horizontal, vertical, or deviated nature of any figure is not to be construed as limiting the wellbore to any particular configuration. As depicted, the well system 100 may suitably comprise a drilling rig 110 positioned on the earth's surface 120 and extending over and around a wellbore 130 penetrating a subterranean formation 125 for the purpose of recovering hydrocarbons and such. The wellbore 130 may be drilled into the subterranean formation 125 using any suitable drilling technique. In an embodiment, the drilling rig 110 comprises a derrick 112 with a rig floor 114. The drilling rig 110 may be conventional and may comprise a motor driven winch and/or other associated equipment for extending a work string, a casing string, or both into the wellbore 130.

In an embodiment, the wellbore 130 may extend substantially vertically away from the earth's surface 120 over a vertical wellbore portion 132, or may deviate at any angle from the earth's surface 120 over a deviated or horizontal wellbore portion 134. In an embodiment, the wellbore 130 may comprise one or more deviated or horizontal wellbore portions 134. In alternative operating environments, portions or substantially all of the wellbore 130 may be vertical, deviated, horizontal, and/or curved. The wellbore 130, in this embodiment, includes a casing string 140. In the embodiment of FIG. 1, the casing string 140 is secured into position in the subterranean formation 125 in a conventional manner using cement 150.

In accordance with the disclosure, the well system 100 includes one or more fracturing zones. While only two fracturing zones (e.g., a lower fracturing zone 160 and upper fracturing zone 170) are illustrated in FIG. 1, and it is further illustrated that the two fracturing zones are located in a horizontal section of the wellbore 130, it should be understood that the number of fracturing zones for a given well system 100 is almost limitless, and the location of the fracturing zones should not be limited to horizontal portions of the wellbore 130. In the embodiment of FIG. 1, the lower fracturing zone 160 has already been fractured, as illustrated by the fractures 165 therein. In contrast, the upper fracturing zone 170 has not been fractured, but in this embodiment is substantially ready for fracturing. Fracturing zones, such as those in FIG. 1, may vary is depth, length (e.g., 30-150 meters in certain situations), diameter, etc., and remain within the scope of the present disclosure.

The well system 100 of the embodiment of FIG. 1 further includes a service tool assembly 180 manufactured in accordance with this disclosure positioned in and around (e.g., in one embodiment at least partially between) the lower fracturing zone 160 and upper fracturing zone 170. Again, while the service tool assembly 180 is positioned in a horizontal section of the wellbore 130 in the embodiment of FIG. 1, other embodiments exist wherein the service tool assembly 180 is positioned in a vertical or deviated section of the wellbore 130 and remain within the scope of the disclosure. In the embodiment of FIG. 1, the service tool assembly 180, with the assistance of other fracturing apparatuses (e.g., upper and lower zone packer assemblies), is configured to substantially if not completely isolate the upper fracturing zone 170 from the lower fracturing zone 160. By isolating the upper fracturing zone 170 from the lower fracturing zone 160 during the fracturing process, the upper fracturing zone 170 may more easily be fractured. Additionally, the isolation may protect the lower fracturing zone (and more particularly the fluid loss device of the lower fracturing zone 160) from the fracturing process.

While the well system 100 depicted in FIG. 1 illustrates a stationary drilling rig 110, one of ordinary skill in the art will readily appreciate that mobile workover rigs, wellbore servicing units (e.g., coiled tubing units), and the like may be similarly employed. Further, while the well system 100 depicted in FIG. 1 refers to a wellbore penetrating the earth's surface on dry land, it should be understood that one or more of the apparatuses, systems and methods illustrated herein may alternatively be employed in other operational environments, such as within an offshore wellbore operational environment for example, a wellbore penetrating subterranean formation beneath a body of water.

Figure 2:
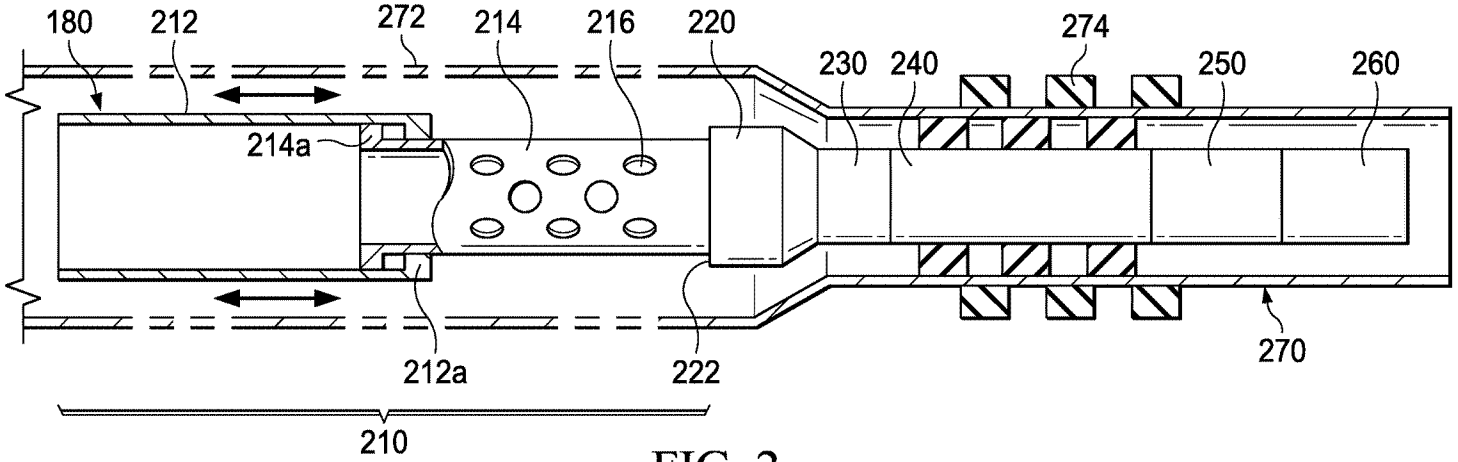
FIG. 2 illustrates one embodiment of the oil/gas service tool assembly illustrated in FIG. 1.

Turning to FIG. 2, illustrated is one embodiment of the oil/gas service tool assembly 180 illustrated in FIG. 1. The surface tool assembly 180, in the embodiment of FIG. 2, includes a washpipe apparatus 210. The washpipe apparatus 210, in accordance with the disclosure, includes an uphole washpipe portion 212 and a downhole washpipe portion 214 having washpipe perforations 216 therein. The uphole washpipe portion 212 and downhole washpipe portion 214, in the embodiment shown, are telescopingly coupled to one another, as shown by the arrows. More specific to the embodiment of FIG. 2, the downhole washpipe portion 214 telescopes within the uphole washpipe portion 212. Other embodiments may exist wherein the uphole washpipe portion 212 telescopes within the downhole washpipe portion 214.

The uphole washpipe portion 212 and downhole washpipe portion 214, in one embodiment, include corresponding stops 212*a*, 214*a*, respectively, for preventing the uphole washpipe portion 212 from disengaging from the downhole washpipe portion 214 when the oil/gas service tool assembly 180 is being drawn uphole (e.g., at such time as the fracturing of the upper fracturing zone 170 is complete). Those skilled in the art understand that any type and/or configuration for the stops 212*a*, 214*a* is within the purview of the present disclosure.

The washpipe apparatus 210 may comprise a variety of different lengths, diameters, etc. and remain within the confines of the disclosure. In one embodiment, such as shown, the uphole washpipe portion 212 has a length ranging from about 2.0 meters to about 200 meters, and a diameter ranging from about 2.5 centimeters to about 13 centimeters, and the downhole washpipe portion 214 has a length ranging from about 2.0 meters to about 10 meters, and a diameter ranging from about 2.5 centimeters to about 18 centimeters. Again, other lengths and diameters may be employed.

The service tool assembly 180, as shown in one embodiment, may further include a no go adapter 220 and a washpipe check valve 230. In the particular embodiment of FIG. 2, the no go adapter 220 is coupled between a downhole end of the downhole washpipe portion 214 and the washpipe check valve 230. In this embodiment, an uphole shoulder 222 of the no go adapter 220 is configured to engage with a downhole shoulder of the uphole washpipe portion 212 (e.g., the stops 212*a* in one embodiment) to push the washpipe check valve 230 downhole when the oil/gas service tool assembly 180 is being pushed downhole. For example, as the service tool assembly 180 is being pushed downhole, the uphole washpipe portion 212 would telescope downhole over the downhole washpipe portion 214 until the stops 212*a* contact the uphole shoulder 222 of the no go adapter 220, wherein the entire service tool assembly 180 would then move downhole.

The service tool assembly 180 of the embodiment of FIG. 2 further includes a seal assembly 240 coupled to a downhole end of the washpipe check valve 230. The seal assembly, in one embodiment, includes one or more sump seals. The service tool assembly 180, in this embodiment, further including a pup joint 250 coupled to the seal assembly 240, and a shifter 260 for a fluid loss device (not shown) coupled to the pup joint 250.

At least partially surrounding the service tool assembly 180, in the illustrated embodiment of FIG. 2, is a packer assembly 270. The packer assembly 270, as might be used in the environment illustrated in FIG. 1, is an upper zone packer assembly that is positioned at least partially within the upper fracturing zone. The packer assembly 270, in the illustrated embodiment, includes an upper zone gravel packer (not shown), a well screen 272 placed downhole of the upper zone gravel packer, and one or more seals 274 placed on an exterior surface thereof. As is illustrated, it is desirable to have the washpipe perforations 216 placed proximate a downhole region of the well screen 272. For example, in one embodiment it is desirable to have the washpipe perforations 216 within about one to two meters of the downhole region of the well screen 272. As those skilled in the art appreciate, doing so helps the fracturing process achieve improved results. As a result of the telescoping nature of the uphole washpipe portion 212 and the downhole washpipe portion 214, the washpipe perforations 216 may remain substantially fixed proximate the downhole region of the well screen 272, even though the uphole washpipe portion 212 is telescoping between a run state and circulate state.

Figure 3:
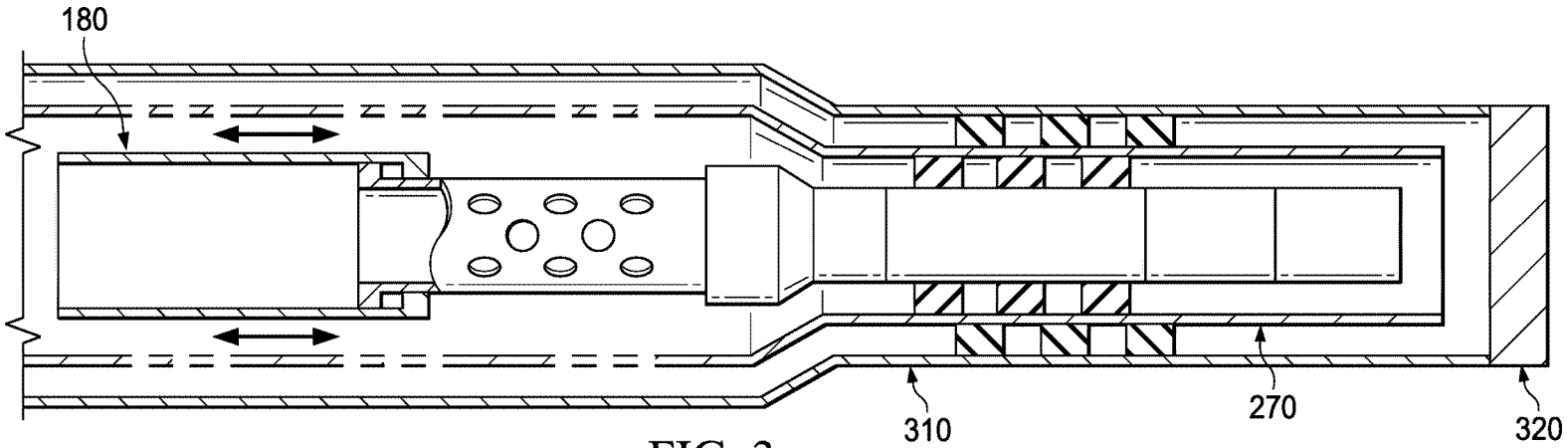
FIG. 3 illustrates the service tool assembly and a portion of the upper zone packer assembly appropriately placed within a lower packer assembly.

Turning briefly to FIG. 3, illustrated are the service tool assembly 180 and a portion of the upper zone packer assembly 270 appropriately placed within a lower packer assembly 310. The lower zone packer assembly 310, in this embodiment, includes a fluid loss device 320. In the illustrated embodiment, and in accordance with the principles of the present disclosure, a downhole portion of the upper zone packer assembly 270 is stinged into the lower zone packer assembly 310. Accordingly, when used in a well system such as the well system 100, the lower fracturing zone 160 would be substantially, if not completely, isolated from the upper fracturing zone 170. At this point (e.g., with the lower fracturing zone 160 substantially isolated from the upper fracturing zone 170) the fracturing of the upper fracturing zone 170 may commence, including using high-pressure fluid and propants.

Figure 4A:
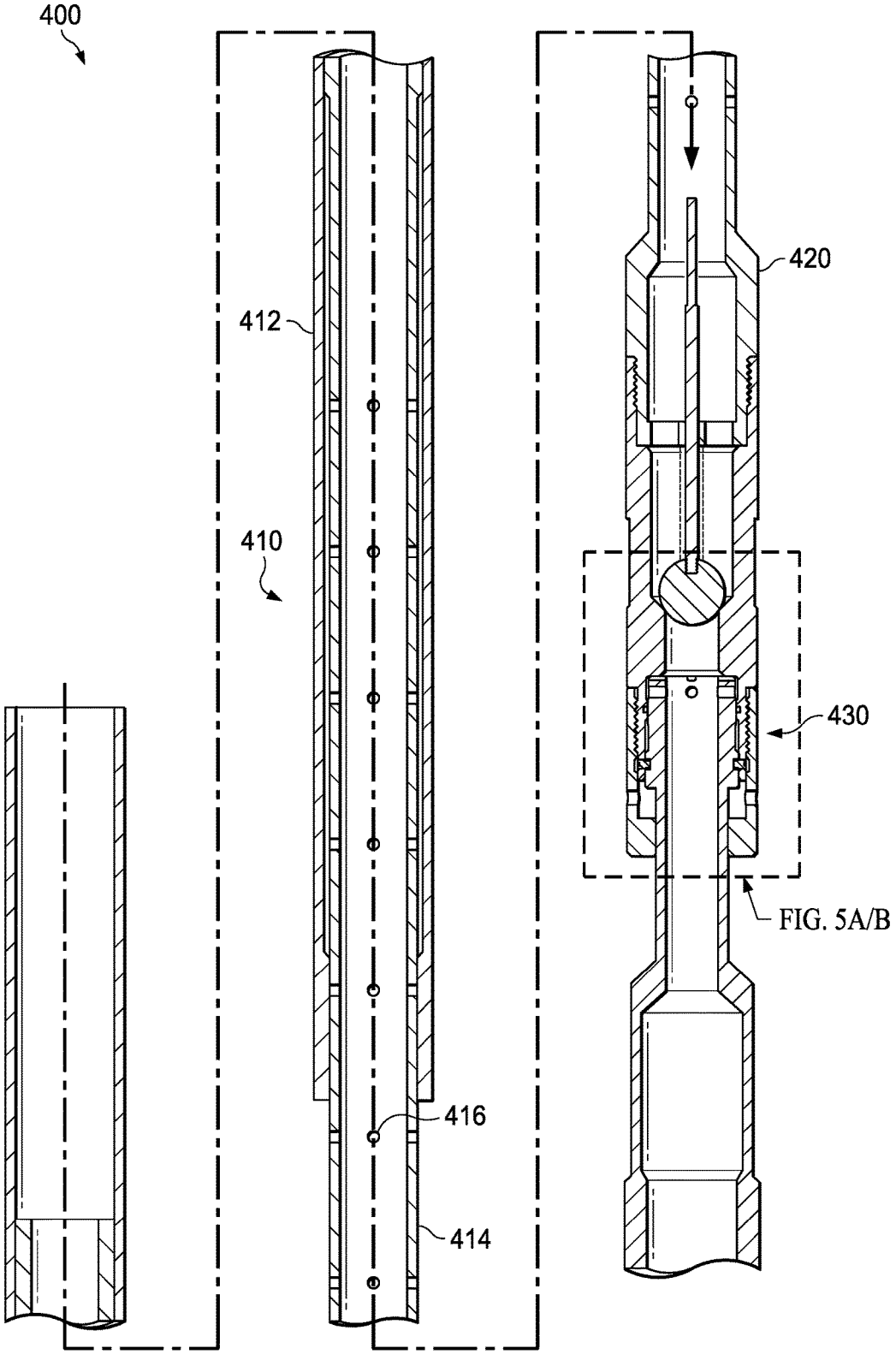
FIGS. 4A through 4C illustrate another embodiment of a service tool assembly at various different positions within the wellbore.
Figure 4B:
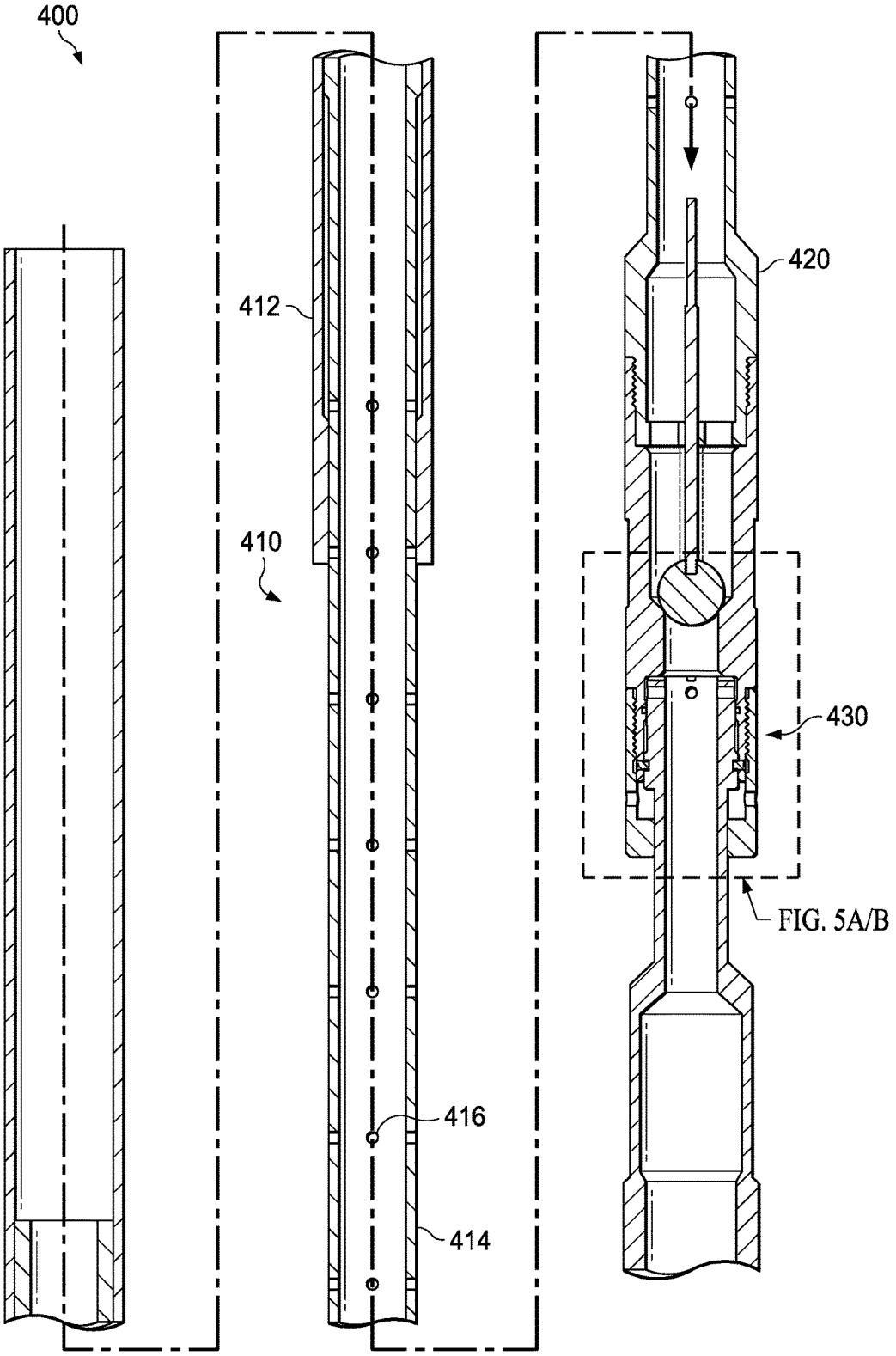
Figure 4C:
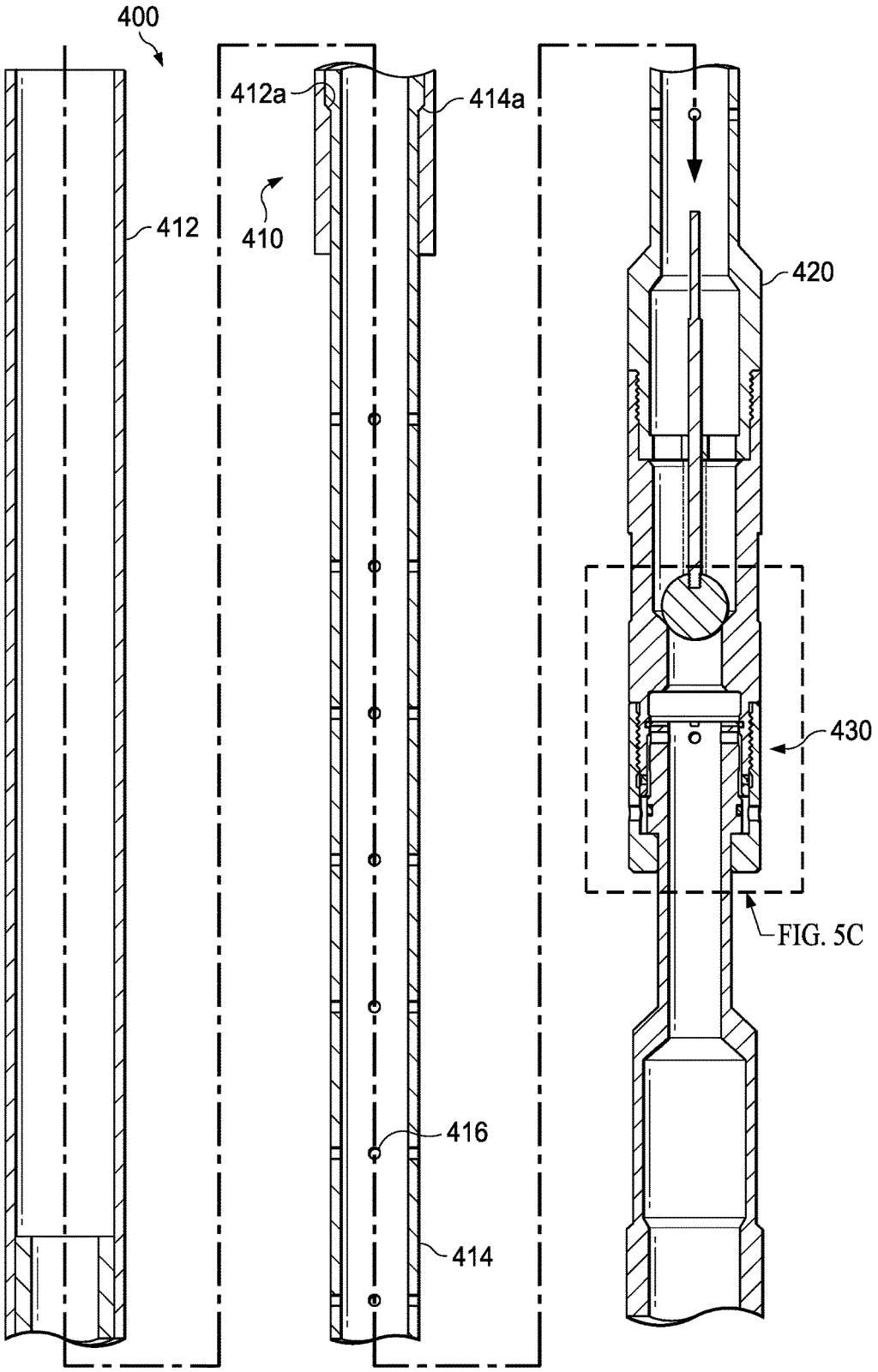

Turning to FIGS. 4A through 4C, illustrated is another embodiment of a service tool assembly 400 at various different positions within the wellbore. Given the significant length of the service tool assembly 400, it has been broken into three different sections, the left most section being the uphole end and the right most section being the downhole end, as shown by the dotted lines and arrows. The service tool assembly 400 includes a washpipe apparatus 410, which includes an uphole washpipe portion 412 and a downhole washpipe portion 414. In accordance with the disclosure, the uphole washpipe portion 412 and downhole washpipe portion 414 are telescopingly coupled to one another. The service tool assembly 400 further includes a no go adapter 420, as well as the washpipe check valve 430.

FIG. 4A illustrates the service tool assembly 400 in a space out or run state. The space out or run state is the position of the uphole washpipe portion 412 relative to the downhole washpipe portion 414 shortly after the service tool assembly 400, and thus upper zone packer assembly (e.g., 270 in FIG. 2) have been stung into the lower zone packer assembly (e.g., 310 in FIG. 3). Typically, the washpipe perforations 416 have been appropriately positioned within the wellbore at this state, and about one to two meters of stroke length has been created between the uphole washpipe portion 412 and the no go adapter 420.

FIG. 4B illustrates the service tool assembly 400 in a circulate state. The circulate state is the position of the uphole washpipe portion 412 relative to the downhole washpipe portion 414 during the fracturing process. Accordingly, the washpipe perforations 416 circulate the high pressure fracturing fluids and propants to and from the subterranean formation. With this process, the subterranean formation may be fractured, and at the same time the lower zone packer assembly and fluid loss device are isolated from the fracturing process. Typically, about two to three meters of stroke length has been created between the uphole washpipe portion 412 and the no go adapter 420 during the circulate state.

FIG. 4C illustrates the service tool assembly 400 in a reverse state. The reverse state is the position of the uphole washpipe portion 412 relative to the downhole washpipe portion 414 when the stops 412*a* and 414*a* are nearly engaging one another. Moreover, the reverse state is that state prior to the service tool assembly 400 being removed from the wellbore. Typically, about five to about 6 meters of stroke length has been created between the uphole washpipe portion 412 and the no go adapter 420 during the reverse state.

Turning now to FIGS. 5A/5B and 5C, illustrated are enlarged renderings of the washpipe check valve 430 during the run/circulate states and reverse state, respectively, of FIGS. 4A/4B and 4C. The washpipe check valve 430 illustrated in FIGS. 5A/5B and 5C includes a ball check 510 and ball seat 520. The ball check 510, which is a solid ball check that does not leak or weep in this embodiment, is configured to engage the ball seat 520 from an uphole direction. Accordingly, pressure upon the ball check 510 seals the uphole portion of the washpipe check valve 430 from the downhole portion of the washpipe check valve 430. In certain embodiment, not shown, a tension member such as a spring may be used to maintain a small amount of pressure on the ball check 510.

The washpipe check valve 430 illustrated in FIGS. 5A/5B and 5C further includes a downhole pressure relief apparatus 540 coupled downhole of the ball seat 520. The downhole pressure relief apparatus 540, in this embodiment, is configured to prevent a hydraulic lock between the ball check 510 and a fluid loss device located there below, as the service tool assembly is being drawn uphole. The downhole pressure relief apparatus 540, in certain embodiments, may have an uphole pressure relief portion 550, and a downhole pressure relief portion 560 slidingly engaging the uphole pressure relief portion 550.

The downhole pressure relief apparatus 540, in accordance with the disclosure, may further include a shear feature 570 (e.g., shear pin in one embodiment) placed between the uphole pressure relief portion 550 and the downhole pressure relief portion 560. The shear feature 570, when used, is configured to keep the uphole pressure relief portion 550 and downhole pressure relief portion 560 substantially fixed with respect to one another when the uphole washpipe portion and downhole washpipe portion telescope with respect to one another, such as when in the run state and circulate state shown in FIGS. 4A and 4B. The shear feature 570, however, is configured to shear when the service tool assembly is being drawn uphole, such as when in the reverse state (or shortly thereafter) shown in FIG. 4C. In essence, when the service tool assembly is being pushed downhole, a no go shoulder 565 on the uphole end of the downhole pressure relief portion 560 prevents the shear feature 570 from shearing. However, when the service tool assembly is being drawn uphole and the uphole washpipe portion and downhole washpipe portion are fully extended, a shear force is placed upon the shear feature 570 causing it to shear. The shear feature 570 may comprise a shear pin, shear bolt, shear screw, among other shear feature designs, and remain within the purview of the disclosure. The shear feature 570, in accordance with the disclosure, may have a tensile strength less than about ten thousand pounds. In yet another embodiment, the shear feature 570 may have a tensile strength ranging from about two thousand pounds to about eight thousand pounds, and in yet another embodiment have a tensile strength of less than about five thousand pounds.

Figure 5C:
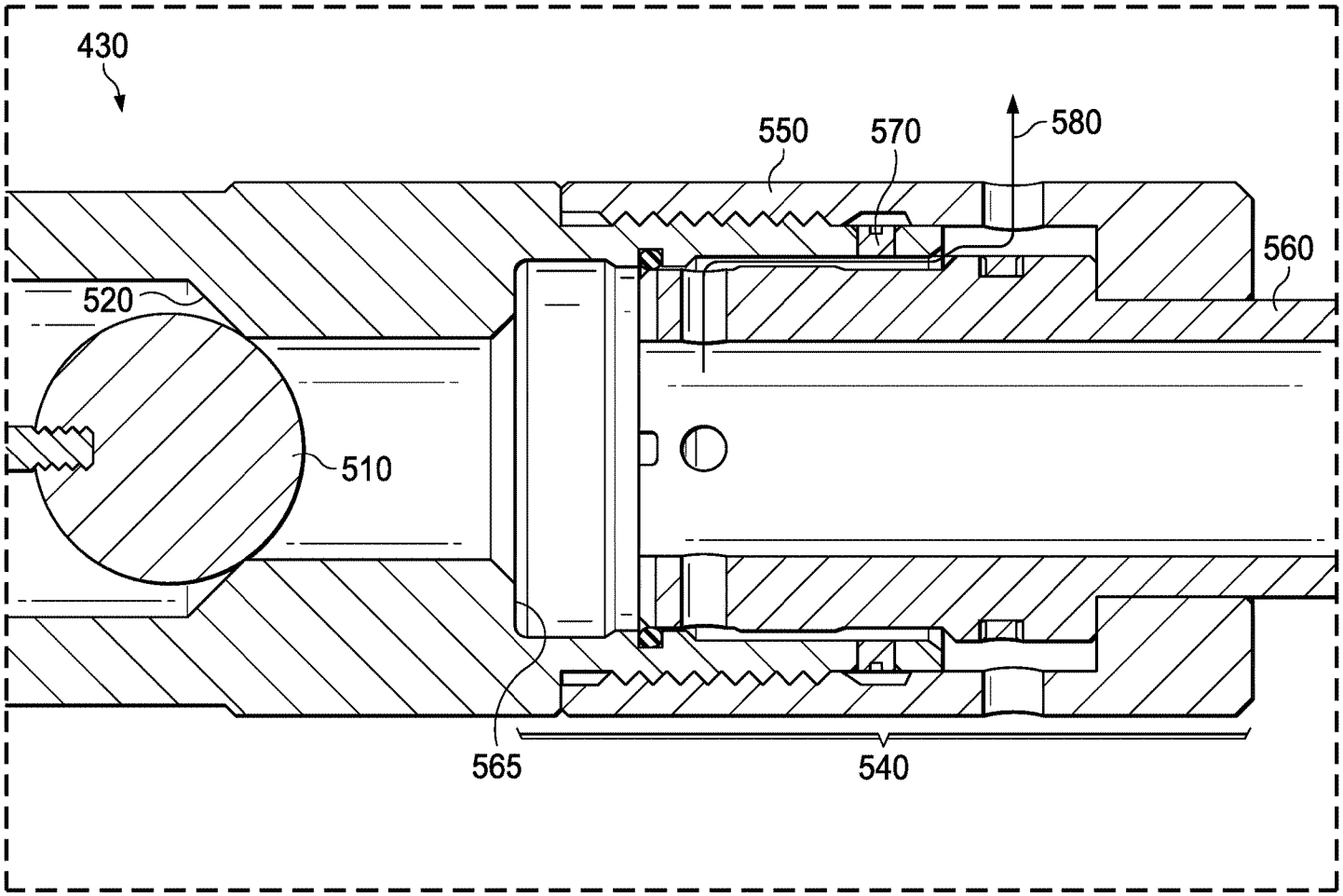
FIGS. 5A/5B and 5C illustrate enlarged renderings of the washpipe check valve during the run/circulate states and reverse state, respectively, of FIGS. 4A/4B and 4C.

In accordance with the disclosure, the uphole pressure relief portion 550 and downhole pressure relief portion 560 are slidingly configured to expose a fluid lock path 580 between an interior of the oil/gas service tool assembly and an exterior of the oil/gas service tool when the shear feature 570 shears. Thus, when the service tool assembly is being withdrawn uphole, for example where there is a circumstance for a hydraulic lock downhole, the shear feature 570 would shear, substantially equalizing the pressure uphole and downhole. FIG. 5A/5B illustrates the washpipe check valve 430 prior to the shear feature 570 shearing, and FIG. 5C illustrates the washpipe check valve 430 after the shear feature 570 shearing.

The apparatuses, systems and methods of the present disclosure have many advantages over existing apparatuses, systems and methods. For the example, apparatuses prevent frac pressure of the upper zone from reaching the lower zone, protecting fluid loss devices in the lower zone, as well as the formation itself. Additionally, as discussed above, the present apparatuses prevent a hydraulic lock between the check valve and the closed fluid los device there below. Moreover, the apparatuses are not dependent on bottom hole pressure, frac pressure, or pulling a vacuum against the fluid loss device. Additionally, the return circulation ports in the washpipe do not move when re-locating the service tool to different states (e.g., run, circulation, reverse). Additionally, the check valve does not shear or weep when the upper frac zone frac pressure is applied, thus it is not dependent on accurate shear pin installation. Moreover, the simple, cost effective, and can be standardized for a given casing size.

Aspects disclosed herein include:

A. An oil/gas service tool assembly, including a washpipe apparatus that includes an uphole washpipe portion and a downhole washpipe portion having washpipe perforations therein, wherein the uphole washpipe portion and downhole washpipe portion are telescopingly coupled to one another, as well as a washpipe check valve coupled downhole of the downhole washpipe portion.

B. A well system, the well system including a wellbore penetrating a subterranean formation and forming a lower fracturing zone and an upper fracturing zone, a lower zone packer assembly positioned at least partially within the lower fracturing zone, an upper zone packer assembly positioned at least partially within the upper fracturing zone, the lower zone packer assembly and upper zone packer assembly configured to substantially isolate the lower fracturing zone from the upper fracturing zone, and an oil/gas service tool assembly cooperatively engaging the upper zone packer assembly. The oil/gas service tool assembly, in this aspect includes a washpipe apparatus having an uphole washpipe portion and a downhole washpipe portion having washpipe perforations therein, wherein the uphole washpipe portion and downhole washpipe portion are telescopingly coupled to one another, as well as a washpipe check valve coupled downhole of the downhole washpipe portion.

C. A method for completing a well system, including forming a wellbore penetrating a subterranean formation, the wellbore including a lower fracturing zone and an upper fracturing zone, positioning a lower zone packer assembly at least partially within the lower fracturing zone, the lower zone packer assembly including a fluid loss device, cooperatively engaging an oil/gas service tool assembly with an upper zone packer assembly. The oil/gas service tool assembly, in this aspect, has a washpipe apparatus including an uphole washpipe portion and a downhole washpipe portion having washpipe perforations therein, wherein the uphole washpipe portion and downhole washpipe portion are telescopingly coupled to one another, and a washpipe check valve coupled downhole of the downhole washpipe portion. The method further includes stinging a downhole portion of the upper zone packer assembly into the lower zone packer assembly such that the washpipe perforations are appropriately placed within the upper fracturing zone, thereby substantially isolating the lower fracturing zone from the upper fracturing zone, and fracturing the upper fracturing zone, including telescoping the uphole washpipe portion and downhole washpipe portion in relation to one another while the washpipe perforations remain substantially fixed within the upper fracturing zone.

Aspects A, B and C may have one or more of the following additional elements in combination:

Element 1: wherein the downhole washpipe portion telescopes within the uphole washpipe portion. Element 2: wherein the downhole washpipe portion and uphole washpipe portion have corresponding stops for preventing the uphole washpipe portion from disengaging from the downhole washpipe portion when the oil/gas service tool assembly is being drawn uphole. Element 3: wherein a no go adapter is coupled between a downhole end of the downhole washpipe portion and the washpipe check valve, and further wherein an uphole shoulder of the no go adapter is configured to engage with a downhole shoulder of the uphole washpipe portion to push the washpipe check valve downhole when the oil/gas service tool assembly is being pushed downhole. Element 4: further including a seal assembly coupled to a downhole end of the washpipe check valve. Element 5: wherein the seal assembly includes one or more sump seals. Element 6: wherein the washpipe check valve includes a ball check and ball seat, the ball check configured to engage the ball seat from an uphole direction. Element 7: wherein the washpipe check valve further includes a downhole pressure relief apparatus coupled downhole of the ball seat, the downhole pressure relief apparatus configured to prevent a hydraulic lock between the ball check and a fluid loss device located there below as the oil/gas service tool assembly is being drawn uphole. Element 8: wherein the downhole pressure relief apparatus has an uphole pressure relief portion and a downhole pressure relief portion slidingly engaging the uphole pressure relief portion. Element 9: further including a shear feature placed between the uphole pressure relief portion and the downhole pressure relief portion, the shear feature configured to keep the uphole pressure relief portion and downhole pressure relief portion substantially fixed with respect to one another when the uphole washpipe portion and downhole washpipe portion telescope with respect to one another, but configured to shear when the oil/gas service tool assembly is being drawn uphole. Element 10: wherein the shear feature is a shear pin, and further wherein the uphole pressure relief portion and downhole pressure relief portion are slidingly configured to expose a fluid lock path between an interior of the oil/gas service tool assembly and an exterior of the oil/gas service tool when the shear pin shears. Element 11: wherein the shear pin has a tensile strength of less than about five thousand pounds. Element 12: wherein the lower zone packer assembly includes a fluid loss device, and further wherein the oil/gas service tool protects the fluid loss device from pressures generated when subjecting the upper fracturing zone to a fracturing process. Element 13: wherein the upper zone packer assembly extends within an opening in the lower zone packer assembly. Element 14: wherein the upper zone packer assembly includes a well screen and one or more seals thereon. Element 15: wherein the uphole washpipe portion telescopes in relation to the downhole washpipe portion while moving between a run state and a circulate state. Element 16: wherein a no go adapter is coupled between a downhole end of the downhole washpipe portion and the washpipe check valve, and further wherein an uphole shoulder of the no go adapter is configured to engage with a downhole shoulder of the uphole washpipe portion when stinging the downhole portion of the upper zone packer assembly into the lower packer assembly. Element 17: further including drawing the oil/gas service tool uphole after the fracturing. Element 18: wherein the downhole washpipe portion and uphole washpipe portion have corresponding stops for preventing the uphole washpipe portion from disengaging from the downhole washpipe portion when the oil/gas service tool assembly is being drawn uphole. Element 19: wherein the washpipe check valve includes a ball check and ball seat, the ball check configured to engage the ball seat from an uphole direction, and a downhole pressure relief apparatus coupled downhole of the ball seat, the downhole pressure relief apparatus preventing a hydraulic lock between the ball check and a fluid loss device located there below when drawing the oil/gas service tool uphole after the fracturing. Element 20: wherein the downhole pressure relief apparatus has an uphole pressure relief portion and a downhole pressure relief portion slidingly engaging the uphole pressure relief portion. Element 21: wherein the downhole pressure relief apparatus further includes a shear feature placed between the uphole pressure relief portion and the downhole pressure relief portion, the shear feature keeping the uphole pressure relief portion and downhole pressure relief portion substantially fixed with respect to one another when telescoping the uphole washpipe portion and downhole washpipe portion in relation to one another between a run state and a circulate state, but shearing when drawing the oil/gas service tool uphole after the fracturing. Element 22: wherein the shear feature is a shear pin, and further wherein a fluid lock path between an interior of the oil/gas service tool and an exterior of the oil/gas service tool is exposed when the shear pin shears when drawing the oil/gas service tool uphole after the fracturing. Element 23: wherein the shear pin has a tensile strength of less than about five thousand pounds.

Those skilled in the art to which this application relates will appreciate that other and further additions, deletions, substitutions and modifications may be made to the described embodiments.

What is claimed is:

1. An oil/gas service tool assembly, comprising:

a washpipe apparatus, including;

an uphole washpipe portion; and a downhole washpipe portion having washpipe perforations therein, wherein the uphole washpipe portion and downhole washpipe portion are telescopingly coupled to one another, wherein the downhole washpipe portion and uphole washpipe portion have corresponding stops for preventing the uphole washpipe portion from disengaging from the downhole washpipe portion when the oil/gas service tool assembly is being drawn uphole; and a washpipe check valve coupled downhole of the downhole washpipe portion.

2. The oil/gas service tool assembly of claim 1, wherein the downhole washpipe portion telescopes within the uphole washpipe portion.

3. The oil/gas service tool assembly of claim 1, wherein a no go adapter is coupled between a downhole end of the downhole washpipe portion and the washpipe check valve, and further wherein an uphole shoulder of the no go adapter is configured to engage with a downhole shoulder of the uphole washpipe portion to push the washpipe check valve downhole when the oil/gas service tool assembly is being pushed downhole.

4. The oil/gas service tool assembly of claim 1, further including a seal assembly coupled to a downhole end of the washpipe check valve.

5. The oil/gas service tool assembly of claim 4, wherein the seal assembly includes one or more sump seals.

6. The oil/gas service tool assembly of claim 1, wherein the washpipe check valve includes a ball check and ball seat, the ball check configured to engage the ball seat from an uphole direction.

7. The oil/gas service tool assembly of claim 6, wherein the washpipe check valve further includes a downhole pressure relief apparatus coupled downhole of the ball seat, the downhole pressure relief apparatus configured to prevent a hydraulic lock between the ball check and a fluid loss device located there below as the oil/gas service tool assembly is being drawn uphole.

8. The oil/gas service tool assembly of claim 7, wherein the downhole pressure relief apparatus has an uphole pressure relief portion and a downhole pressure relief portion slidingly engaging the uphole pressure relief portion.

9. The oil/gas service tool assembly of claim 8, further including a shear feature placed between the uphole pressure relief portion and the downhole pressure relief portion, the shear feature configured to keep the uphole pressure relief portion and downhole pressure relief portion substantially fixed with respect to one another when the uphole washpipe portion and downhole washpipe portion telescope with respect to one another, but configured to shear when the oil/gas service tool assembly is being drawn uphole.

10. The oil/gas service tool assembly of claim 9, wherein the shear feature is a shear pin, and further wherein the uphole pressure relief portion and downhole pressure relief portion are slidingly configured to expose a fluid lock path between an interior of the oil/gas service tool assembly and an exterior of the oil/gas service tool when the shear pin shears.

11. The oil/gas service tool assembly of claim 10, wherein the shear pin has a tensile strength of less than about five thousand pounds.

12. A well system, comprising:

a wellbore penetrating a subterranean formation and forming a lower fracturing zone and an upper fracturing zone;

a lower zone packer assembly positioned at least partially within the lower fracturing zone;

an upper zone packer assembly positioned at least partially within the upper fracturing zone, the lower zone packer assembly and upper zone packer assembly configured to substantially isolate the lower fracturing zone from the upper fracturing zone;

an oil/gas service tool assembly cooperatively engaging the upper zone packer assembly, the oil/gas service tool assembly including;

a washpipe apparatus, including;

an uphole washpipe portion; and a downhole washpipe portion having washpipe perforations therein, wherein the uphole washpipe portion and downhole washpipe portion are telescopingly coupled to one another, wherein the downhole washpipe portion and uphole washpipe portion have corresponding stops for preventing the uphole washpipe portion from disengaging from the downhole washpipe portion when the oil/gas service tool assembly is being drawn uphole; and a washpipe check valve coupled downhole of the downhole washpipe portion.

13. The well system as recited in claim 12, wherein the lower zone packer assembly includes a fluid loss device, and further wherein the oil/gas service tool protects the fluid loss device from pressures generated when subjecting the upper fracturing zone to a fracturing process.

14. The well system as recited in claim 12, wherein the upper zone packer assembly extends within an opening in the lower zone packer assembly.

15. The well system as recited in claim 12, wherein the upper zone packer assembly includes a well screen and one or more seals thereon.

16. A method for completing a well system, comprising:

forming a wellbore penetrating a subterranean formation, the wellbore including a lower fracturing zone and an upper fracturing zone;

positioning a lower zone packer assembly at least partially within the lower fracturing zone, the lower zone packer assembly including a fluid loss device;

cooperatively engaging an oil/gas service tool assembly with an upper zone packer assembly, the oil/gas service tool assembly including;

a washpipe apparatus, including;

an uphole washpipe portion; and a downhole washpipe portion having washpipe perforations therein, wherein the uphole washpipe portion and downhole washpipe portion are telescopingly coupled to one another, wherein the downhole washpipe portion and uphole washpipe portion have corresponding stops for preventing the uphole washpipe portion from disengaging from the downhole washpipe portion when the oil/gas service tool assembly is being drawn uphole; and a washpipe check valve coupled downhole of the downhole washpipe portion;

stinging a downhole portion of the upper zone packer assembly into the lower zone packer assembly such that the washpipe perforations are appropriately placed within the upper fracturing zone, thereby substantially isolating the lower fracturing zone from the upper fracturing zone;

fracturing the upper fracturing zone, including telescoping the uphole washpipe portion and downhole washpipe portion in relation to one another while the washpipe perforations remain substantially fixed within the upper fracturing zone.

17. The method of claim 16, wherein the uphole washpipe portion telescopes in relation to the downhole washpipe portion while moving between a run state and a circulate state.

18. The method of claim 16, wherein a no go adapter is coupled between a downhole end of the downhole washpipe portion and the washpipe check valve, and further wherein an uphole shoulder of the no go adapter is configured to engage with a downhole shoulder of the uphole washpipe portion when stinging the downhole portion of the upper zone packer assembly into the lower packer assembly.

19. The method of claim 16, further including drawing the oil/gas service tool uphole after the fracturing.

20. The method claim 19, wherein the washpipe check valve includes a ball check and ball seat, the ball check configured to engage the ball seat from an uphole direction, and a downhole pressure relief apparatus coupled downhole of the ball seat, the downhole pressure relief apparatus preventing a hydraulic lock between the ball check and a fluid loss device located there below when drawing the oil/gas service tool uphole after the fracturing.

21. The method of claim 20, wherein the downhole pressure relief apparatus has an uphole pressure relief portion and a downhole pressure relief portion slidingly engaging the uphole pressure relief portion.

22. The method of claim 21, wherein the downhole pressure relief apparatus further includes a shear feature placed between the uphole pressure relief portion and the downhole pressure relief portion, the shear feature keeping the uphole pressure relief portion and downhole pressure relief portion substantially fixed with respect to one another when telescoping the uphole washpipe portion and downhole washpipe portion in relation to one another between a run state and a circulate state, but shearing when drawing the oil/gas service tool uphole after the fracturing.

23. The method of claim 22, wherein the shear feature is a shear pin, and further wherein a fluid lock path between an interior of the oil/gas service tool and an exterior of the oil/gas service tool is exposed when the shear pin shears when drawing the oil/gas service tool uphole after the fracturing.

24. The method of claim 22, wherein the shear pin has a tensile strength of less than about five thousand pounds.

* * * * *